US009301072B2

(12) United States Patent
Reining

(10) Patent No.: US 9,301,072 B2
(45) Date of Patent: Mar. 29, 2016

(54) TRANSDUCER WITH MOTION CONTROL

(71) Applicant: Knowles IPC (M) Sdn. Bhd., Penang (MY)

(72) Inventor: Friedrich Reining, Vienna (AT)

(73) Assignee: Knowles IPC (M) SDN. BHD., Penang (MY)

( * ) Notice: Subject to any disclaimer, the term of this patent is extended or adjusted under 35 U.S.C. 154(b) by 22 days.

(21) Appl. No.: 14/383,360

(22) PCT Filed: Mar. 1, 2013

(86) PCT No.: PCT/SG2013/000085

§ 371 (c)(1),
(2) Date: Sep. 5, 2014

(87) PCT Pub. No.: WO2013/133765

PCT Pub. Date: Sep. 12, 2013

(65) Prior Publication Data

US 2015/0016620 A1 Jan. 15, 2015

Related U.S. Application Data

(60) Provisional application No. 61/606,827, filed on Mar. 5, 2012.

(51) Int. Cl.
*H04R 29/00* (2006.01)
*H04R 3/00* (2006.01)

(52) U.S. Cl.
CPC ..... *H04R 29/001* (2013.01); *H04R 3/007* (2013.01); *H04R 2499/11* (2013.01)

(58) Field of Classification Search
None
See application file for complete search history.

(56) References Cited

U.S. PATENT DOCUMENTS 5,197,104 A 3/1993 Padi

FOREIGN PATENT DOCUMENTS

DE 199 60 979 A1 12/1999
EP 2 355 542 A1 8/2011

OTHER PUBLICATIONS

International Search Report & Written Opinion,PCT/SG2013/000085, Mar. 1, 2013.
International Preliminary Report on Patentability & Written Opinion, PCT/SG2013/000085, Mar. 1, 2013.

*Primary Examiner* — Paul Huber
(74) *Attorney, Agent, or Firm* — Steven McMahon Zeller; Dykema Gossett PLLC

(57) ABSTRACT

An audio system comprises an electro-acoustic transducer (1) with transducer connections (12, 13) to receive an audio signal (AS) in the audio frequency range from a driver circuit (14) and measure means (11) to measure the excursion of a diaphragm (3) of the electro-acoustic transducer (1), wherein a sensor signal source (16) provides a sensor signal (SS) at the transducer connections (12, 13) with a sensor frequency beyond the audio frequency range and in the range of the resonance frequency of the electro-acoustic transducer and, wherein the measure means (11) comprise a sensor circuit (18) to sense changes of the impedance of the electro-acoustic transducer (1) for the sensor signal (SS) at the transducer connections (12, 13) caused by the excursion of the diaphragm (3) due to the audio signal (AS).

18 Claims, 4 Drawing Sheets

TRANSDUCER WITH MOTION CONTROL

FIELD OF THE INVENTION

The present invention generally relates to an audio system that comprises an electro-acoustic transducer with transducer connections to receive an audio signal in a considered audio frequency range from a driver circuit and measure means to measure the excursion of a diaphragm of the electro-acoustic transducer.

The present invention furthermore relates to a method to measure the excursion of a diaphragm of an electro-acoustic transducer.

BACKGROUND OF THE INVENTION

Such audio systems are for instance used in mobile phones for which devices the considered audio frequency is typically 10 Hz to 20 kHz. In such mobile applications size of components always matters. This holds true for electro-acoustic transducers like microphones and loudspeakers. The latter are disadvantaged as loudness directly deals with the amount of moved air within the loudspeaker. Higher sound level demands together with smaller size demands can only be realized, if all parts of the loudspeaker are optimally designed.

In order to fulfill the high sound level requirement, moved air volume needs to be maximized and floor space of the whole loudspeaker needs to be minimized. This leads to high excursions of the diaphragm which leads to a decreasing adaptability for a linear loudspeaker model.

A common way of modeling a loudspeaker basically in a linear matter consists of three parts as shown in FIG. 1:

The electrical model (consisting of a resistor $R_{conductor}$ and the voice coil inductance $Z_{coil}$)

The mechanical model (consisting of the mass $M_{MS}$, spring $C_{MS}$ and damping component $R_{MS}^{-1}$ of the moving diaphragm and voice coil)

The acoustic model (consisting of the acoustical mass Ma, the acoustical compliance Ca and the acoustical resistance Ra)

This model can be used to predict the behavior of a loudspeaker if parameters are known. To gain most acoustic power out of the loudspeaker, all parts need to be adapted to the thermal and mechanical stress. The voice coil temperature due to the driving current needs to be taken into account as well as the excursion, which is limited by diaphragm design or even hard limited by basket or the magnet system. Taking the electrical, the mechanical and the acoustic model into account a main loudspeaker resonance frequency may be evaluated.

Spread in mechanical dimensions, production processes etc. lower the theoretical power limit of a loudspeaker. To augment this limitation two basic concepts have been developed in the past:

Motion Control of the Diaphragm by Additional Sensing Voice Coil

As described in the U.S. Pat. No. 4,327,250, a sensing voice coil is mounted in addition to the voice coil on the moving diaphragm and provides information about the diaphragm velocity. This information is used in the driver circuit to adjust the audio signal and limit the excursion of the diaphragm. To track not only the velocity, but also the absolute position of the diaphragm, a condenser principle can be used to obtain the relative position of the diaphragm.

Motion Control by Modeling the Motion

This approach is far more complicated, for it adapts a linear or even non-linear model to online measurements of the voice coil current and voltage. This model is based on static parameters like the magnetic flux B times the length of the voice coil wire, the known mass and the static resistance of the voice coil. Based on these model parameters and the measured values for current and voltage an excursion estimate can be computed and therefore controlled.

Drawbacks for these Two Basic Concepts

The true motion control as described in the U.S. Pat. No. 4,327,250 requires an additional sensing mechanisms (like the sensing voice coil and one or two additional sensor transducer connections) and wiring of this mechanism in addition to the transducer connections, but is robust against any spread in the whole transducer chain including the acoustic situation to which the loudspeaker is applied.

The modeling approach avoids additional transducer connections of the loudspeaker, but needs a lot of digital signal processing power and the results are only as robust as the model reflects the "real world".

SUMMARY OF THE INVENTION

It is an objective of the presented invention to provide an audio system and measure means for such an audio system and a device with an electro-acoustic transducer and a method to measure the excursion of a diaphragm of the electro-acoustic transducer that avoids the drawbacks of the known basic concepts.

This objective is achieved with an audio system that furthermore comprises a sensor signal source to provide a sensor signal at the transducer connections with a sensor frequency beyond the considered audio frequency range and in the range of the electrical domain resonance frequency of the electro-acoustic transducer and, that the measure means comprise a sensor circuit to sense changes of the impedance of the electro-acoustic transducer for the sensor signal at the transducer connections caused by the excursion of the diaphragm due to the audio signal.

This objective is furthermore achieved with a method that processes the following steps:

Apply a frequency sweep signal with a frequency beyond a considered audio frequency range at two transducer connections connected to a voice coil of the electro-acoustic transducer to measure the electrical domain resonance frequency of the electro-acoustic transducer;

Fix the sensor frequency of a sensor signal with a frequency shift below or above the measured electrical domain resonance frequency of the electro-acoustic transducer or fix the sensor frequency of the sensor signal at the measured electrical domain resonance frequency of the electro-acoustic transducer;

Sense the change of the impedance of the electro-acoustic transducer for the sensor signal at the transducer connections caused by the excursion of the diaphragm due to the audio signal at the voice coil.

This provides the advantage that there is no need for additional transducer connections or an additional sensing voice coil or high digital signal processing power, while the excursion of the diaphragm sensed by the measure means is the result of a robust measurement on the particular electro-acoustic transducer. Several parameters of electro-acoustic transducers may differ due to minor differences in material or production or due to altering over time. This excursion measurement enables to adjust the DC component of the audio signal and other parameters to enable an optimized use of the particular electro-acoustic transducer.

These and other aspects of the invention will be apparent from and elucidated with reference to the embodiments described hereinafter. The person skilled in the art will understand that various embodiments may be combined.

DETAILED DESCRIPTION OF EMBODIMENTS

Figure 2:
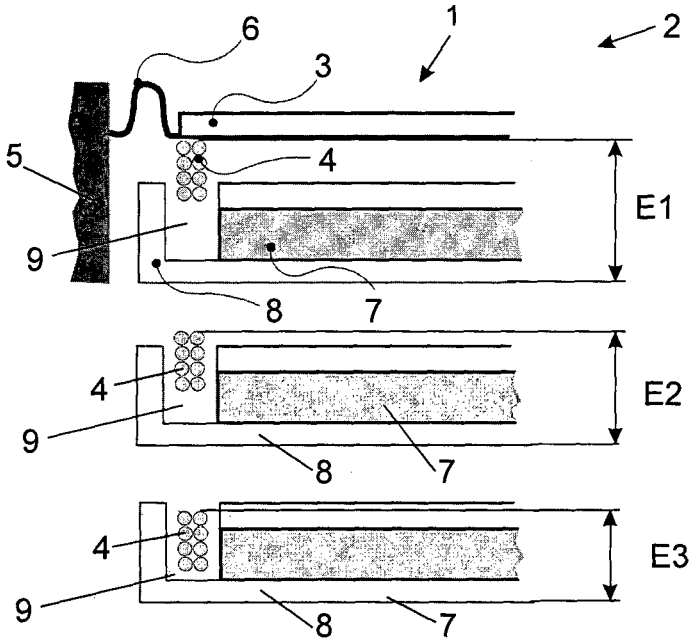
FIG. 2 shows the principle parts of a loudspeaker.

FIG. 2 shows the principle parts of an electro-acoustic transducer or loudspeaker 1 that is part of an audio system 2. The loudspeaker 1 comprises a diaphragm 3 with a voice coil 4 connected to it. The diaphragm 3 is furthermore connected to a chassis 5 of the loudspeaker 1 via a suspension 6. The loudspeaker 1 furthermore comprises a magnet 7 housed in a pot or casing 8. The voice coil 4 reaches into an air gap 9 between the magnet 7 and the casing 8.

Figure 3:
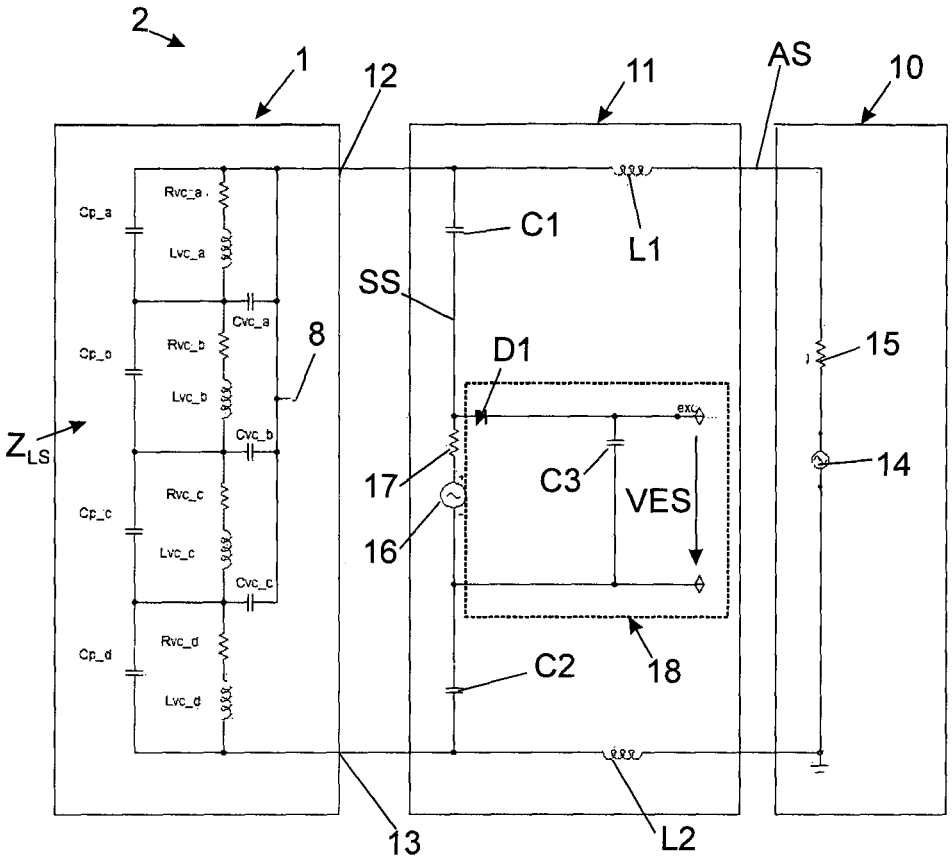
FIG. 3 shows an audio system with measure means to measure the excursion of a diaphragm according to a first embodiment of the invention.

FIG. 3 shows a circuit diagram of the audio system 2 according to a first embodiment of the invention with a driver circuit 10 to provide an audio signal AS and with measure means 11 to measure and furthermore to control the excursion of the diaphragm 3. The driver circuit 10 comprises an audio signal source 14 with its resistance 15 and provides the audio signal AS to two transducer connections 12 and 13 of the loudspeaker 1. If the driver circuit 10 provides the audio signal AS in the considered audio signal range of typically 20 Hz to 20 kHz via the two transducer connections 12 and 13 to the voice coil 4, then the voice coil 4 moves within the air gap 9. As a result the diaphragm 3 moves into different excursions E1, E2 and E3 of the diaphragm 3, as shown in the upper and middle and lower picture of FIG. 2.

It has to be stated that the considered audio signal range depends upon the loudspeaker used and upon the application a particular device housing the loudspeaker is used for. There are applications where only the audio signal range of e.g. 20 Hz to 100 Hz or of e.g. 5 kHz to 20 kHz could be considered to be relevant to transport the relevant acoustic information.

FIG. 3 shows a more detailed electrical model in the electrical domain of the loudspeaker 1 where the wire of the voice coil 4 is modeled as a combination of inductors, resistors and capacities. The magnitude of the loudspeaker impedance $Z_{LS}$ shows the characteristic shape described by the simplified formula where a transformation of the serial connection $R_L$ and L has been applied with (source: Wikipedia)

$$R_P = \frac{L}{R_L C}$$

-continued $$\frac{1}{Z_{LS}} = \frac{1}{j\omega L} + \frac{1}{R_P} + j\omega C$$

Figure 1:
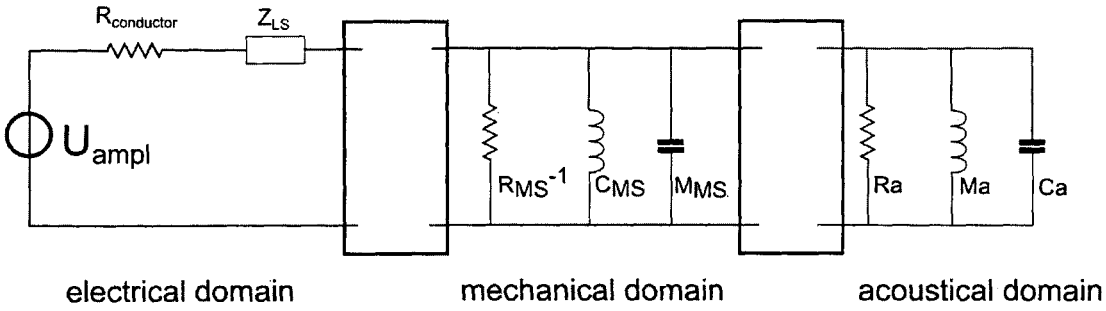
FIG. 1 shows a common way of modeling a loudspeaker.

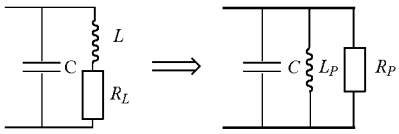

$$f_0 = \frac{1}{2\pi\sqrt{LC}}$$

Where $R_p$ denotes the resistance of the wire, L the inductance and C the capacity against each winding as well as the casing 8 which in this embodiment is electrically connected to the transducer connection 12. This setup leads to a loudspeaker 1 that does not have an electrical domain resonance frequency RF in the considered audio frequency range, but has an electrical domain resonance frequency RF in the MHz range assuming a micro loudspeaker. This electrical domain resonance frequency RF of the loudspeaker 1 is the resonance frequency in the electrical domain as shown in the model of FIG. 1. The electrical domain resonance frequency RF therefore is influenced by the components found in the electrical domain as there are voice coil resistance, contact resistance, voice coil inductance and capacitance both being influence by surrounding electro-dynamically active components.

Figure 4:
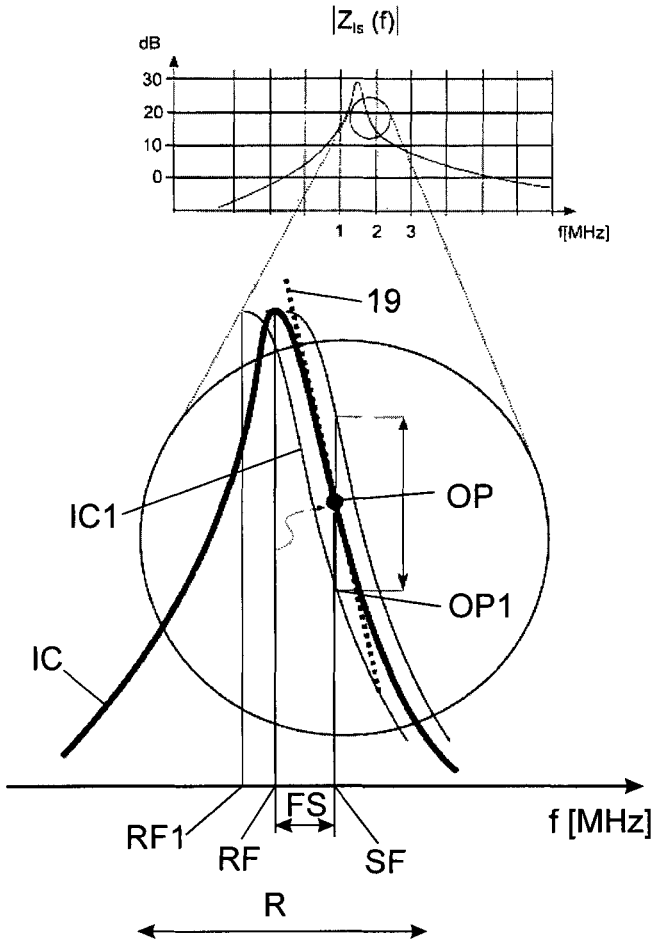
FIG. 4 shows an impedance curve of the electro-acoustic transducer for a frequency sweep signal and a sensor signal beyond the considered audio frequency range.

The measure means 11 comprise a sensor signal source 16 with its resistance 17 that provides a sensor signal SS at the transducer connections 12 and 13. FIG. 4 shows an impedance curve IC for the impedance $Z_{LS}$ with a frequency sweep signal above the considered audio frequency range at the transducer connections 12 and 13. The impedance curve IC clearly shows the electrical domain resonance frequency RF of the loudspeaker 1. The sensor signal SS has a sensor frequency SF beyond the considered audio frequency range and in the range R of the electrical domain resonance frequency RF of the loudspeaker. The range R could already start close beyond the end of the considered audio frequency range although changes of the impedance $Z_{LS}$ at low frequencies like e.g. 20 kHz would be small and difficult to measure. In the embodiment shown in FIG. 4 the sensor frequency SF is chosen with a frequency shift FS of a few kHz beyond the measured electrical domain resonance frequency RF. The sensor frequency SF is chosen as to lie within the inflection point of the impedance curve IC what enables a linearization 19 for small deflections around an operation point OP for the sensor signal SS.

Since we deal here with an anti-resonant circuitry with losses, the diaphragm movement will not only change the electrical domain resonance frequency RF due to a changed inductance, but also change the quality factor of the anti-resonant circuitry. This change will be seen in the absolute value of the impedance, in the phase response as well as the electrical domain resonance frequency RF which results in a lower resonance frequency.

$$fr = \frac{1}{2\pi}\sqrt{\frac{1}{LC} - \frac{R_L^2}{L^2}}$$

The measure means 11 furthermore comprise a sensor circuit 18 to sense the change of the impedance $Z_{LS}$ of the loudspeaker 1 for the sensor signal SS at the transducer connections 12 and 13 caused by the excursion of the diaphragm 3 due to the audio signal AS at the voice coil 4. The movement of the voice coil 4 changes the capacitance and inductance of the impedance $Z_{LS}$ resulting in a different impedance curve IC1 and resonance frequency RF1 of the loudspeaker 1. This shift of the impedance curve from IC to IC1 results in a shift of the operation point from OP to OP1 for the sensor signal SS with the sensor frequency SF. This shift of the operation point OP is sensed by the sensor circuit 18 as will be explained below.

The sensor circuit 18 of the measure means 11 is connected with the two transducer connections via two capacitors C1 and C2 to essentially block the audio signal AS and let pass the sensor signal SS. Furthermore the driver circuit 10 is connected with the two transducer connections 12 and 13 via two inductances L1 and L2 of the measure means 11 to essentially block the sensor signal SS and let pass the audio signal AS. As a result the audio signal AS from the driver circuit 10 will mainly see the loudspeaker 1, with small additional impedances due to the inductances L1 and L2, but rather high impedances in parallel due to the capacitors C1 and C2. Advantageously, the audio signal AS of the driver circuit 10 will therefore not be influenced by the measure means 11.

The sensor circuit 18 of the measure means 11 according to the first embodiment is realized by an AM demodulation with diode D1 and capacity C3 that makes use of the inductive element L1 found in the second realization. In the audio frequency range the sensor circuit 18 is only "visible" by means of its wire resistance, for higher frequencies the sensor circuit 18 acts as impedance, preferably in the same range of the impedance $Z_{LS}$ of the loudspeaker 1 at the operating point OP and the sensor frequency SF. A shift in impedance $Z_{LS}$ of the loudspeaker 1 results in an amplitude change between the inductance L1 and the inductance LS (sum of Lvc_a and Lvc_b and Lvc_c and Lvc_d) of the loudspeaker 1. This results in a voltage excursion signal VES that is correlated to the excursion of the diaphragm 3 of the loudspeaker 1.

The voltage excursion signal VES includes an AC and a DC component and can be used to alter the zero position (no audio signal AS at the transducer connections 12 and 13) of the diaphragm 3 or to measure the excursion of the loudspeaker 1. It is furthermore possible to compensate by applying application matched sinusoidal frequencies that act together with a nonsymmetrical acoustic hole as a micro pump. Various parameters of the loudspeaker 1 or of a microphone may be adjusted based on the knowledge about the actual excursion of the diaphragm.

The audio system 1 enables a simple excursion measurement with an analogue circuitry that can be used to measure the actual excursion and therefore over time to measure the motion of diaphragm 3. Based on this measurement with the knowledge of the absolute position of the diaphragm 3 at any time it is possible to compensate for offsets of the diaphragm 3 position via a direct current applied to the voice coil 4. For certain loudspeaker models an excursion factor with dimension V/mm can be found in order to get a true mechanical measure of the excursion.

Figure 5:
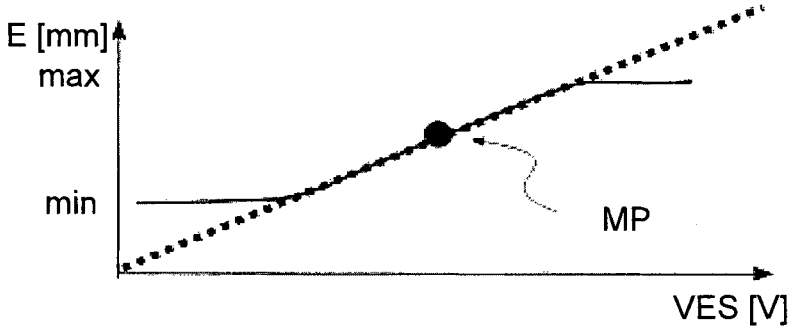
FIG. 5 shows the correlation of the excursion of the diaphragm and the voltage excursion signal.

The audio system 1 furthermore enables to run a starting up procedure. During this starting up procedure a test signal is applied to the transducer connections 12 and 13 to measure the correlation of the excursion of the diaphragm 4 and the change of the impedance $Z_{LS}$ of the loudspeaker 1 for the sensor signal SS at the transducer connections 12 and 13. This for instance enables to find the mid position MP as shown in FIG. 5. As test signal e.g. a sine signal with a frequency approximately at the main loudspeaker resonance frequency including all domains as there are the electrical, mechanical and acoustical domain, for which excursion is maximal with a amplitude near excursion maximum can be used. For micro speaker this main resonance frequency is typically in the range of 500 Hz to 1 kHz.

Taking the assumption that the parameters for L and C of the impedance $Z_{LS}$ inside the loudspeaker 1 are stable during production it is possible to find the absolute position of the diaphragm 3 even without the starting up procedure to measure the particular loudspeaker 1. If these values tend to vary too much the starting up procedure enables to find the mid position MP and the max and min values of the excursion.

In one embodiment a device like a mobile phone could the first time it is powered-up or at every power-up provide a maximal and minimal audio signal AS as a test signal to the transducer connectors 12 and 13 and deflect the diaphragm to the max and minimum excursion value. The voltage excursion signal VES levels of these positions would be stored and used further on as limits for the maximal excursion of the diaphragm 3 and as limit for the maximal audio signal AS.

In the first embodiment the casing 8 is connected to the transducer connection 12. This ensures robustness as the electrical potential of the casing 8 is fixed. As the change of the impedance $Z_{LS}$ is mainly influenced by the change of the inductivity it is not a must to connect the casing 8 with one of the transducer connections 12 or 13.

Since the loudspeaker 1 is used outside of its resonance frequency as an anti-resonant circuitry, adding a capacity parallel to the transducer connections 12 and 13 pulls the electrical domain resonance frequency RF of the loudspeaker 1 to a lower frequency. If the electrical domain resonance frequency RF of the loudspeaker 1 would be for instance 10 MHz, such an additional capacity of 100 pF would reduce the resonance frequency to only 4 MHz, what could be advantageous if for any system integration reasons the primary resonance frequency of the coil impedance is by means of e.g. interference not acceptable.

A shift of the electrical domain resonance frequency RF into the audio frequency range is also possible as long as the considered audio frequency range is not influenced by means of degrading the perceived signal quality of the considered audio signal to be transmitted. A subwoofer with a very narrow bandwidth up to 200 Hz can therefore be sensed at a high audio frequency (e.g. 19 kHz).

Figure 6:
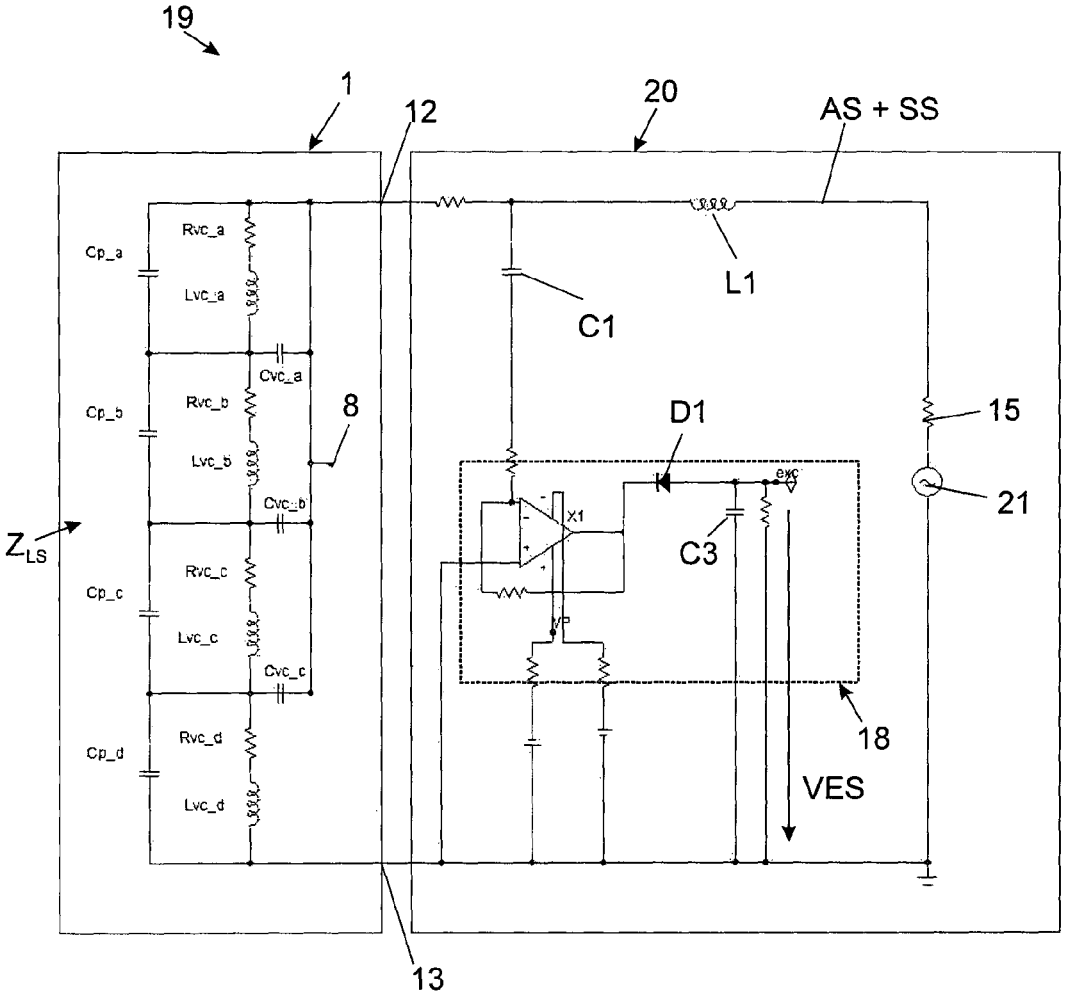
FIG. 6 shows an audio system with measure means to measure the excursion of a diaphragm according to a second embodiment of the invention.

FIG. 6 shows an audio system 19 with a combined driver and measure means 20 to measure the excursion of the diaphragm 3 according to a second embodiment of the invention. In this embodiment the driver circuit 21 provides a combined audio signal AS in the considered audio frequency range and sensor signal SS in the frequency range beyond the considered audio frequency range. An operational amplifier is designed to act as a impedance transformer in order not to influence the loudspeaker 1.

The measure means 11 and 20 process a method to measure the excursion of the diaphragm 3 of the loudspeaker 1 whereby the following steps are taken:

The sensor signal source 16 applies the frequency sweep signal with a frequency beyond the considered audio frequency range at the two transducer connections 12 and 13 connected to the voice coil 4 of the loudspeaker 1 to measure the electrical domain resonance frequency RF of the loudspeaker 1. As a next step sensor signal setting means of the measure means 11 and 20—not shown in the figures—fix the sensor frequency SF of a sensor signal SS with the frequency shift FS below or above the measured electrical domain resonance frequency RF of the loudspeaker 1. As a next step the sensor circuit 18 senses the change of the impedance of the loudspeaker 1 for the sensor signal SS at the transducer connections 12 and 13 caused by the excursion of the diaphragm 3 due to the audio signal AS at the voice coil 4. This method enables to adjust the parameters of the particular loudspeaker 1 to optimize its acoustic performance.

It is furthermore advantageous to either continuously or periodically or at every power-up of the device comprising the loudspeaker 1 or once during production of the loudspeaker 1 or during production of the device sense the change of the impedance $Z_{LS}$ of the loudspeaker 1 for the sensor signal SS at the transducer connections 12 and 13 caused by the excursion of the diaphragm 3 due to the audio signal AS at the voice coil 4 and adjust the DC component of the audio signal AS or limit the excursion for certain frequency ranges by adaptive filtering to reduce the distortion factor of the loudspeaker 1. This adjustment is done by audio signal adjusting means.

The scope of the application should be understood in that way that electrical components of the audio systems 2 and 19 may be realized by active elements as well based on the knowledge of a man skilled in the art. This leads to high quality filtering with a better use of the audio frequency range and less influence by the sensor signal SS.

If the purely electrical domain driven anti-resonant circuitry is found to be lossy enough, the sensor frequency SF is fixed with the measured electrical domain resonant frequency RF and a shift FS below or above the measured electrical domain resonance frequency RF is obsolete. In that case any excursion of the diaphragm 3 leads to a lower maximum of the impedance curve IC at it's electrical domain resonance frequency RF which is sensed by the sensor circuit 18.

The sensing frequency is not limited to one certain sinusoidal signal, but can be a mixture of any number of signals with a frequency beyond the considered audio band. In case of a multitude of sensing signals the method to detect the impedance changes due to the diaphragm movement must be adapted to these multitude of signals. Advantage of using more sensing signals is to increase the SNR due to the strong correlation of impedance changes at different frequencies.

The voltage excursion signal VES from the sensor circuit 18 that is correlated to the excursion of the diaphragm 3 of the loudspeaker 1 can be used as input signal for an adaptive filter to filter frequencies in the considered audio frequency range. This adaptive filter would ensure that the excursion of the diaphragm 3 can be limited for all frequencies in the considered audio frequency range to provide high quality audio reproduction with a low distortion factor.

What is claimed is:

1. An audio system comprising:

an electro-acoustic transducer having a diaphragm and at least two transducer connection;

a driver circuit configured to generate an audio signal in a considered audio frequency range and deliver the audio signal to the transducer connections; and means for measuring the excursion of the diaphragm of the electro-acoustic transducer, the means for measuring comprising:

a sensor signal source configured to provide a sensor signal at the transducer connections with one or more sensor frequencies beyond the considered audio frequency range and in the range of the electrical domain resonance frequency of the electro-acoustic transducer; and a sensor circuit configured to sense changes of the impedance of the electro-acoustic transducer for the sensor signal at the transducer connections caused by the excursion of the diaphragm due to the audio signal.

2. An audio system according to claim 1, wherein the electro-acoustic transducer furthermore comprises a casing that houses a magnet forming an air gap in-between and a voice coil attached to the diaphragm that reaches into the air gap and, wherein the casing is electrically connected to one of the transducer connections.

3. An audio system according to claim 1, wherein the sensor circuit is connected with the two transducer connections via at least one capacitor to essentially block the audio signal and let pass the sensor signal and, wherein the driver circuit is connected with the two transducer connections via at least one inductance to essentially block the sensor signal and let pass the audio signal.

4. An audio system according to claim 1, wherein the measure means for measuring further comprises sensor signal setting means configured to measure the electrical domain resonance frequency of the electro-acoustic transducer in a first step while a frequency sweep signal above the considered audio frequency range is provided at the transducer connections, and configured to fix the sensor frequency of the sensor signal with a frequency shift below or above the measured electrical domain resonance frequency in a second step.

5. An audio system according to claim 1, wherein the means for measuring further comprises sensor signal setting means configured to measure the electrical domain resonance frequency of the electro-acoustic transducer in a first step while a frequency sweep signal above the considered audio frequency range is provided at the transducer connections, and configured to fix the sensor frequency of the sensor signal at the measured resonance frequency in a second step.

6. An audio system according to claim 1, wherein the means for measurement further comprises audio signal adjusting means configured to adjust the DC component of the audio signal at the driver circuit based on the changes of the impedance of the electro-acoustic transducer sensed with the sensor circuit.

7. An audio system according to claim 1, wherein the sensor circuit comprises a demodulator and a low-pass filter that provides a voltage excursion signal with a voltage amplitude related to the excursion of the diaphragm.

8. An audio system according to claim 1, wherein the driver circuit is configured to provide a combined audio signal and sensor signal to the transducer connections.

9. An audio system according to claim 1, wherein the sensor circuit comprises an operational amplifier configured to act as an impedance transformer in order not to influence the electro-acoustic transducer.

10. A system for measuring the excursion of a diaphragm of an electro-acoustic transducer, the system comprising:

an electro-acoustic transducer comprising a diaphragm and transducer connections a driver circuit configured to transmit an audio signal in a considered audio frequency range to the transducer connections;

a sensor signal source configured to provide a sensor signal at the transducer connections with a sensor frequency beyond the considered audio frequency range and in the range of the electrical domain resonance frequency of the electro-acoustic transducer; and a sensor circuit configured to sense changes of the impedance of the electro-acoustic transducer for the sensor signal at the transducer connections.

11. A method of measuring the excursion of a diaphragm of an electro-acoustic transducer, comprising the steps of:

measuring the electrical domain resonance frequency of the electro-acoustic transducer by applying a frequency sweep signal with a frequency beyond a considered audio frequency range at two transducer connections connected to a voice coil of the electro-acoustic transducer;

applying a sensor signal at the two transducer connections;

sensing the change of the impedance of the electro-acoustic transducer by amplitude modulation for the sensor signal at the transducer connections caused by the excursion of the diaphragm due to the audio signal at the voice coil.

12. The method of claim 11 further comprising the step of applying a test signal in the range of the main loudspeaker resonance frequency of the electro-acoustic transducer to the transducer connections to measure the correlation of the excursion of the diaphragm and the change of the impedance of the electro-acoustic transducer for the amplitude modulated sensor signal at the transducer connections.

13. The method of claim 11 further comprising the step of applying a test signal in the range of the main loudspeaker resonance frequency of the electro-acoustic transducer to the transducer connections to measure the correlation of the applied test signal and the change of the impedance of the electro-acoustic transducer for the sensor signal at the transducer connections.

14. The method of claim 11, wherein the sensor signal has a frequency fixed below or above the measured electrical domain resonance frequency of the electro-acoustic transducer.

15. The method of claim 11, wherein the sensor signal has a frequency fixed at the measured electrical domain resonance frequency of the electro-acoustic transducer.

16. The method of claim 11, further comprising the step of adjusting the DC component of the audio signal based on the change of the impedance of the electro-acoustic transducer to reduce distortions of the electro-acoustic transducer.

17. The method of claim 11, further comprising the step of filtering the audio signal in certain frequency bands based on the change of the impedance of the electro-acoustic transducer to reduce distortions of the electro-acoustic transducer.

18. An audio system comprising:

an electro-acoustic transducer comprising a diaphragm and at least two transducer connections;

a driver circuit, the driver circuit configured to deliver an audio signal to the electro-acoustic transducer via the transducer connections, the audio signal being within a considered audio frequency range;

a sensor signal source, the sensor signal source configured to provide a sensor signal at the transducer connections, the sensor signal having a frequency outside the considered audio frequency range and in the range of the electrical domain resonance frequency of the electro-acoustic transducer; and a sensor circuit, the sensor circuit configured to sense changes in the impedance of the electro-acoustic transducer for the sensor signal at the transducer connections caused by the excursion of the diaphragm due to the audio signal.

* * * * *